US005215462A

United States Patent [19]

Lewis et al.

[11] Patent Number: 5,215,462

[45] Date of Patent: Jun. 1, 1993

[54] WEAPON SIMULATOR

[75] Inventors: Delmar J. Lewis, McLean, Va.; Martin P. Byrne, Poolesville, Md.

[73] Assignee: Advanced Technology Systems, Vienna, Va.

[21] Appl. No.: 748,751

[22] Filed: Aug. 16, 1991

[51] Int. Cl.[5] ..... F41G 1/00

[52] U.S. Cl. ..... 434/19; 434/16; 434/17; 434/21; 273/310; 273/311; 273/312

[58] Field of Search ..... 273/310–312, 273/313, 316; 434/11, 14–17, 19–23

[56] References Cited

U.S. PATENT DOCUMENTS 4,164,081 8/1979 Berke ..... 434/22
4,315,689 2/1982 Goda ..... 434/22 X
4,959,016 9/1990 Lawrence ..... 434/21 X

OTHER PUBLICATIONS

Mobile Missile/Gunnery Simulator Nelson Merritt (TIG) p. 2 sec 1.2 1989.

*Primary Examiner*—Richard J. Apley
*Assistant Examiner*—Glenn E. Richman
*Attorney, Agent, or Firm*—Gary Steven Pisner

[57] ABSTRACT

A weapon simulator that consists of a simulated weapon, a trigger sensor 6 for sensing when the weapon's trigger is pulled, a positional sensor 12 and 16 for determining the position of the simulated weapon relative to a target, and a sensor for determining if the simulated weapon is aimed at the target.

6 Claims, 6 Drawing Sheets

WEAPON SIMULATOR

BACKGROUND

1. Field of the Invention

This invention relates to an apparatus and method for simulating the targeting of various types of weapon systems.

2. Description of Related Art

Non-projectile weapon simulators have been in use throughout this century (see U.S. Pat. Nos. 687,324 (1901) and RE 12,916 (1909)). There are basically two types of weapon simulators, mechanical and light based.

Mechanical simulators can be roughly divided into two classes lever-based and integrated recording device Lever based weapon simulators use mechanical linkages, gears or the equivalent to determine positional characteristics of the simulated weapon such as pitch, roll and orientation. These weapons usually have a lever attached to their stock. The lever engages linkages, gears and/or ropes to move an attached marking device. The marking devices either utilize a "dotter system" or a spike. The dotter system uses an electrical current to char the simulated point of impact The spike can perforate either the target or a film that can be used to project a probable point of impact onto a target area. The second type of non-projectile mechanical weapon simulator uses a marker integrated into the body of the simulator and a recording material that is charred, marked or perforated in a manner that permits one to extrapolate from the recording material a corresponding position on a target (see U.S. Pat. Nos. 2,139,530 (1938) and 4,175,749 (1979)).

These mechanical simulators suffered from one or more limitations, including lack of mobility of the target, restricted movement of the simulated weapon, lack of reliability of a mechanical device, and limited target distance mandated by a mechanical system Light based non-projectile weapon simulators have reached a development plateau after twenty years of development. These simulators use light sources, commonly infrared light sources, or photoelectric sensors attached to or placed within the bore of a simulated weapon (see U.S. Pat. No. RE 28,598). All of these simulators require special targets or target displays that either use a light sensor which responds to the light source emanating from the simulated weapon, or use a target that emanates a beam of light.

There are a number of problems with the light based simulators. The first major problem is their extremely limited range. The target must be at the most 2 to 2.5 meters from the light source. The second major problem is that most of these simulators are sensitive to ambient light. Natural light and artificial light produce electromagnetic noise This noise produces targeting artifacts. The third major problem is that most of these simulators lack the resolution required to accurately determine whether a small target has actually been hit. The last major problem, which is very limiting given the nature of the modern battlefield, is that light based weapon simulations cannot simulate multiple targets.

The present invention has overcome most of the limitations of the mechanical and light weapon simulator systems described above, including:

(a) The simulator weapon in this invention can be designed to have the feel and the freedom of motion of the weapon simulated. This invention is not restrained by mechanical linkages; there is no restriction on the mobility of the target or the simulated weapon. One embodiment of this invention permits one simply to strap the simulator's directional determining module directly to a functional weapon.

(b) With this invention, environmental conditions do not affect the performance of this simulator; e.g., one can use the simulator indoors or outdoors, under any lighting conditions. This invention is thus an improvement over the light based weapon simulators which are sensitive to peripheral light sources that produce electromagnetic noise.

(c) The resolution of this invention is excellent; the error is plus or minus 0.1 degree, which is equivalent to an error of 1.17 Meters/KM. This resolution permits simulation of a long range weapon system by greatly reducing the size of the target or increasing the distance between the simulator weapon and the target. Although an error of plus or minus 0.1 degree is small, the resolution may be increased by using available mathematical algorithms. A 0.1 degree error is adequate to match the accuracy of any potential weapon system. The mechanical or light based simulators do not permit the distance between the target and the simulator weapon to be more than a few meters; even at one meter their resolution is poor.

(d) This invention can present multiple targets. It is not uncommon for a soldier to be confronted with multiple targets on the battlefield. Light and mechanical simulators lack the ability to present more then one target at a time.

DRAWING FIGURES

FIG. 1 shows one embodiment of the simulator's position sensor.

FIG. 2*a* shows one embodiment of the invention with a display mounted on the side of the missile launching simulator weapon and a modular version of a simulator position sensor.

FIG. 2*b* shows one embodiment of this invention with the simulator position sensor installed in the bore of a missile launching simulator weapon.

DESCRIPTION—FIGS. 1 TO 5

Figure 1:
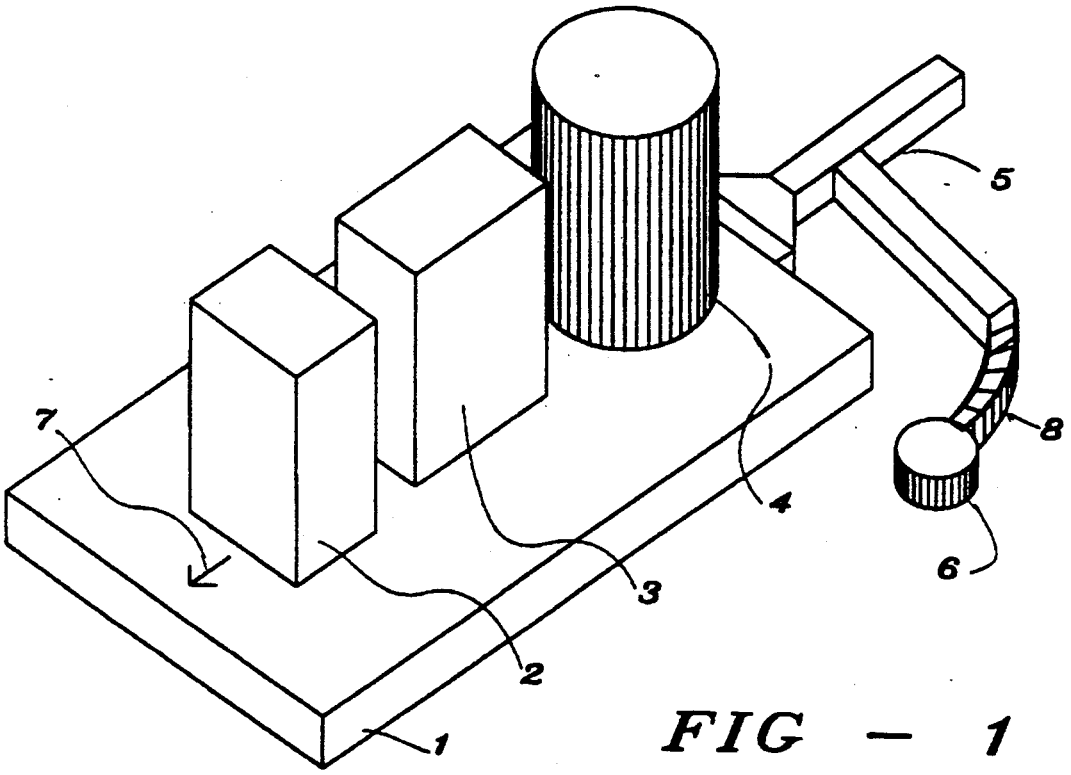

An embodiment of the positional sensor used in this invention is illustrated in FIG. 1. The positional sensor uses a magnetometer 4 with three magnetic field sensors directed at right angles to each other along an x, y and z axis. Each magnetic field sensor produces analog signals corresponding to the strength of a magnetic field in directions corresponding to an x, y and z axis of a three dimensional Cartesian coordinate system in a local reference frame. The local reference frame is the reference frame with its z axis perpendicular to the long axis of the simulator weapon. Two inclinometers 2 and 3 produce analog signals that correspond to the deviation of the magnetometer's reference frame from a reference frame in which the z axis of the coordinate system is parallel to the earth's gravitational field. In this embodiment inclinometer 2 is used to correct for roll, and inclinometer 3 is used to correct for pitch. The magnetometer 4, and the two inclinometers 2 and 3 are mounted on a platform 1. All analog signals generated by the magnetometer 4 and the two inclinometer 2 and 3 are directed through a cable 5 to a computer. An electrical contact or finger pressure activated trigger sensor 6 creates a signal when the simulator weapon's trigger is pulled. The signal from the trigger sensor 6 is conducted through a trigger cable 8 to a computer.

Figure 2A:
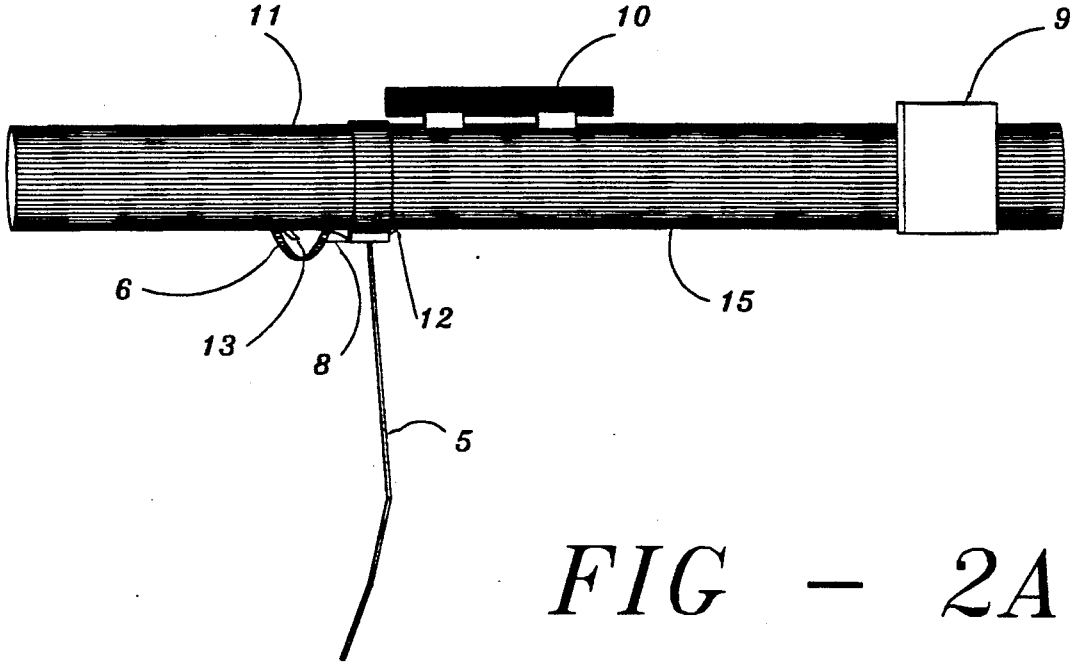

FIG. 2*a* shows an embodiment of this invention with a modular positional sensor 12 of the type described in U.S. Pat. No. 4,656,750. This modular positional sensor 12 combines a three axis magnetometer with multiple accelerometers in one unit. The modular positional sensor 12 is attached to the tube 15 of the simulator weapon with a strap 11. Data generated by the modular positional sensor 12 is conducted through the computer cable 5. This embodiment uses a display 9 mounted on the tube 15 of the simulator weapon. One can view on the display 9 both the target and any other generated landscape. One views the display 9 through a sight 10. When the target is aligned correctly with the cross hairs of the sight 10, the trigger 13 is pulled and a trigger sensor 6 sends a signal through the trigger cable 8 to the computer through the cable 5.

Figure 2B:
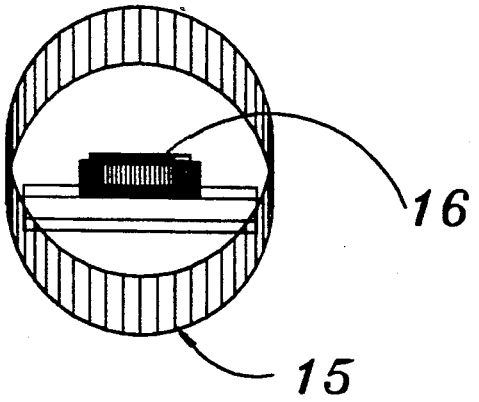

FIG. 2*b* shows an embodiment of this invention with the positional sensor 16 mounted in the bore of the simulated weapon 15. The point of attachment of the positional sensor is dictated by the type of simulated weapon. For example, a simulated weapon with a small diameter bore will require that the positional sensor be mounted on the stock of the simulated weapon. Because the positional sensor uses magnetic fields to determine its position, the point of attachment of the positional sensor 15 also is dictated by the distribution of magnetic flux producing material. The best positional sensor placement is at a point where the magnetic flux producing material is minimal. If there is no acceptable minimal point, equations are used to correct for the weapon's magnetic flux.

Figure 3:
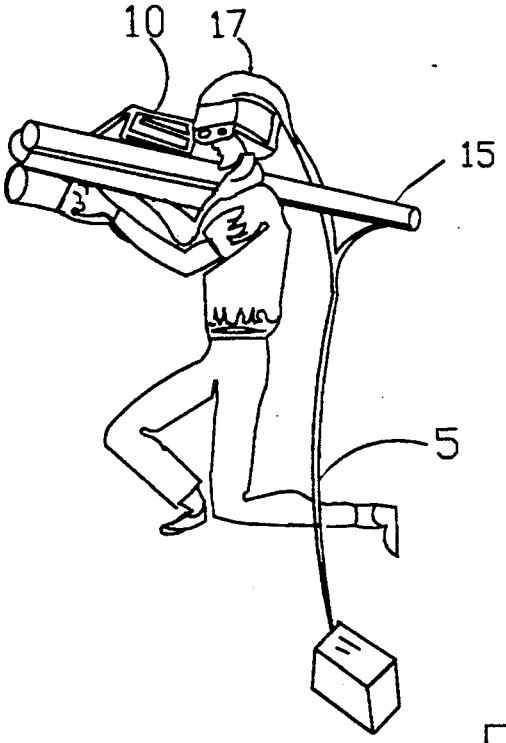
FIG. 3 shows individual using simulator with one display embodiment where the target is displayed on the visor of a helmet.

FIG. 3 shows an embodiment of this invention that includes a simulated weapon's tube 15 with the positional sensor mounted internally (see FIG. 2*b*). with the target and cross hairs projected on the inter surface of the visor system 17 or alternatively inside the simulated weapon's sight 10. When the simulated weapon's tube 15 is moved, the position of the cross hairs projected on the inner surface of the visor moves. The position of the cross hairs on the screen corresponds exactly with the orientation of the axis of the simulated weapon 15. Video signals, positional sensors and trigger sensor are conducted through cable 51

Figure 4:
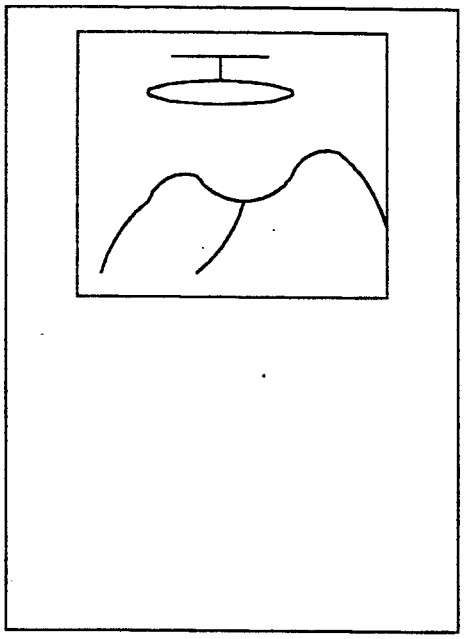
FIG. 4 shows a display with target and terrain.

FIG. 4 shows an embodiment of a display having a simulated target and terrain.

Figure 5:
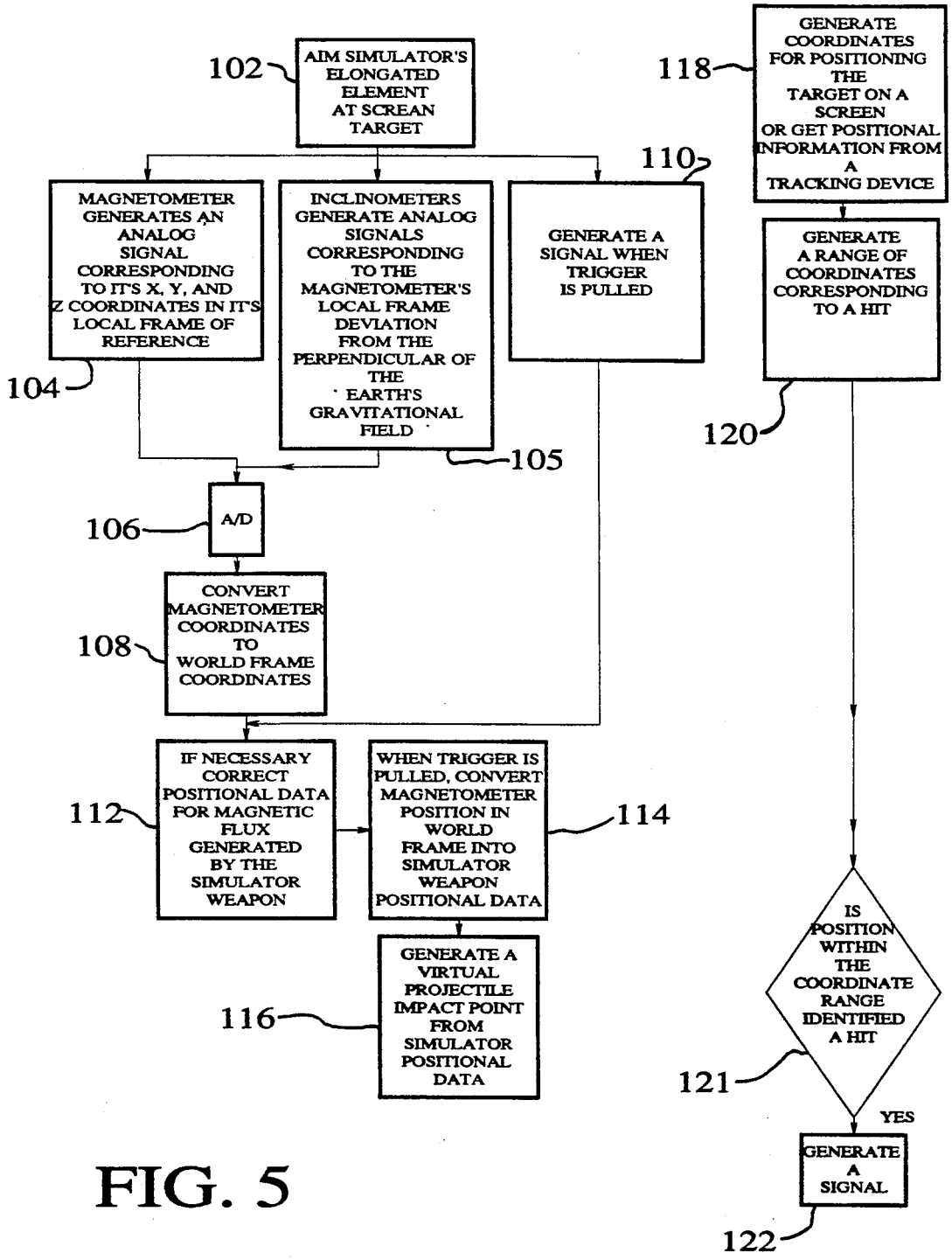
FIG. 5 shows a flowchart outlining the method of processing the output of the simulator's position sensor.

FIG. 5 sets forth the process used by this invention to simulate a weapon system The person using the simulator aims either at a target visible on a display 102 or at a real target such as a tank. The positional sensor is mounted on or inside the simulator weapon. Using its magnetometer, the positional sensor sends out analog signals, corresponding to the magnetic flux levels, in three directions corresponding to the x, y and z axis of a three dimensional Cartesian coordinate system 104. Simultaneously with process step 104, the gravitational sensors, either inclinometers or accelerometer arrays, send out analog signals corresponding to the pitch, roll, and yaw of the simulator weapon 105. The output of both the magnetometer and the gravitational sensors is converted to digital signals using an analog to digital integrated circuit 106. Using mathematical equations that translate the magnetometer coordinates from a local coordinate system to a world coordinate system, and using the data produced by the gravitational sensor array, the magnetometer coordinates are translated from a local frame of reference to a world coordinate system with its z axis parallel to the earth's gravitational field 108. If necessary, at this point the data from the magnetometer is modified to take into consideration any magnetic flux resulting from any metal in the simulator weapon 112. When the trigger of the simulator weapon is pulled, it generates a signal 11 0 and converts the positional data from the magnetometer coordinates set in a world frame to positional data representing the direction in which the simulator weapon is aimed 114. The impact point of a virtual projectile is then calculated using equations that are specific for a given weapon type 116. Targets can be real, can be generated on the display by using a random number generator or can be manually selected by an operator 118. Each target consists of a range of coordinates in the target area that are tagged as hits 120. A signal is produced if the virtual projectile impact point coincides with the coordinates that are tagged as hits.

Although the description above contains many specificities, these should not be construed as limiting the scope of the invention, but as merely illustrating some of the currently preferred embodiments of this invention. For example, the display can be an LCD display, a small CRT display, a holographic display, a large screen with an image projected on a surface, or a real target such as a tank or a helicopter. If a real target is used, the position of the real target can be determined by a radar, by a satellite based GPS system, or by anther type of positional determining device. The weapon sight ideally should match the weapon type that is simulated. The sight can be optical or even a notch. Thus, the scope of the invention should be determined by the appended claims and their legal equivalents, rather than by the examples given.

Having described what is at this time the preferred embodiments of the subject invention, I claim:

1. A weapon simulator, comprising:

(a) at least three magnetic field sensors oriented at right angles along x, y, and z axis;

(b) a means for determining the position of said magnetic sensors relative to the earth's gravitational field;

(c) a base with said magnetic field sensors and said means for determining the position of said magnetic field sensors relative to the earth's gravitational force attached thereto;

(d) a simulated weapon having said base attached to its surface;

(e) a means for determining the position of a target;

(f) a means for converting the analog signals generated by said magnetic field sensors into x, y and z coordinates with said z coordinates perpendicular to the long axis of said simulated weapon;

(g) a means of sensing the pulling of the trigger of said simulator weapon;

(h) a means for rotating the magnetic field sensors derived coordinates using the output of said means for determining the position of said magnetic field sensors derived coordinates relative to the earth's gravitational force to permit the rotated z axis of said magnetic field sensors derived coordinates to be parallel with the earth's gravitational force; and (i) a means of comparing said rotated z axis of said magnetic field sensors derived coordinates that is parallel with the earth's gravitational force with target position derived from said means for determining position of a target when the trigger of said simulated weapon is pulled.

2. A weapon simulator as defined in claim 1 wherein said simulated weapon is made of non-ferromagnetic material.

3. A weapon simulator as defined in claim 1 wherein said means for determining the position of said magnetic field sensors relative to the earth's gravitational force comprising:

(i) a first inclinometer that measures the roll of said magnetic field sensors; and (ii) a second inclinometer that measures the pitch of said magnetic field sensors.

4. A weapon simulator as defined in claim 1 wherein said means for determining position of said target is through the use of a computer generated target position.

5. A weapon simulator as defined in claim 1 wherein said magnetic field sensors are included in a magnetometer having three sensing axes.

6. A method of simulating a weapon system, comprising:

(a) aiming weapon simulator at target;

(b) generating signals from magnetic field sensors corresponding to x, y and z coordinates of a point on said weapon simulator on a Cartesian coordinate system, wherein the z axis coordinate is perpendicular to the weapon simulator's long axis;

(c) generating signals from gravitational sensors corresponding to said weapon simulator's pitch and roll;

(d) transforming coordinates of said point on said simulator weapon so that said point is on a coordinate system which has its z axis parallel to the earth's gravitational field;

(e) sensing when the trigger of the simulator is pulled;

(f) sensing the position of a target; and (g) comparing said point's position with said position of said target when trigger is pulled.

* * * * *